US005695232A

United States Patent [19]

Tipp

[11] Patent Number: 5,695,232

[45] Date of Patent: Dec. 9, 1997

[54] BOTTLE CARRIER

[76] Inventor: Raymond P. Tipp, P.O. Box 3778, Missoula, Mont. 59806

[21] Appl. No.: 558,389

[22] Filed: Nov. 16, 1995

[51] Int. Cl.[6] ..... B65D 23/10

[52] U.S. Cl. ..... 294/87.2; 294/31.2; 294/145; 294/159; 206/150; 215/396

[58] Field of Search ..... 294/27.1, 31.2, 294/33, 87.2, 145, 159, 149, 156; 206/145, 147, 148, 158, 162, 150, 151; 215/396, 397

[56] References Cited

U.S. PATENT DOCUMENTS

| | | | |
|---|---|---|---|
| D. 184,315 | 1/1959 | Jennings et al. | 294/145 |
| 2,227,780 | 1/1941 | Hickman et al. | 294/27.1 |
| 2,680,038 | 6/1954 | Gray | 294/87.2 |
| 4,623,185 | 11/1986 | Thomas | 294/159 |
| 4,798,286 | 1/1989 | Muscanelli | 294/87.2 |
| 5,183,169 | 2/1993 | Grzych | 294/31.2 |

*Primary Examiner*—Dean Kramer
*Attorney, Agent, or Firm*—Harry M. Cross, Jr.

[57] ABSTRACT

A bottle carrier 1 comprises a thin flexible strip 10 that is provided with a bottle-engaging portion 12, a mid-portion 14, and a carrying portion 16. The bottle-engaging portion 12 contains an aperture 18 having a special periphery configured with certain peripheral elements designed to engage the bottle carrier 1 with a bottle 2. Whether the bottle carrier 1 is designed to carry a single bottle, or to carry two bottles, each bottle-engaging portion 12 thereof will have an aperture 18 for each bottle and each aperture 18 will have the special periphery with the aforesaid peripheral elements. Aperture 18 comprises a semi-circular portion bounded by a semi-circular edge 20 that circumscribes an arc of at least 180°, two opposed side edges 22, 24 that extend inward from each end of the semi-circular edge 20 toward one another, a side bottle rim-engaging tab 26 adjacent to side edge 22, a second side bottle rim-engaging tab 28 adjacent to side edge 24, and at least one intermediate bottle rim-engaging tab 30 between tabs 26 and 28.

14 Claims, 9 Drawing Sheets

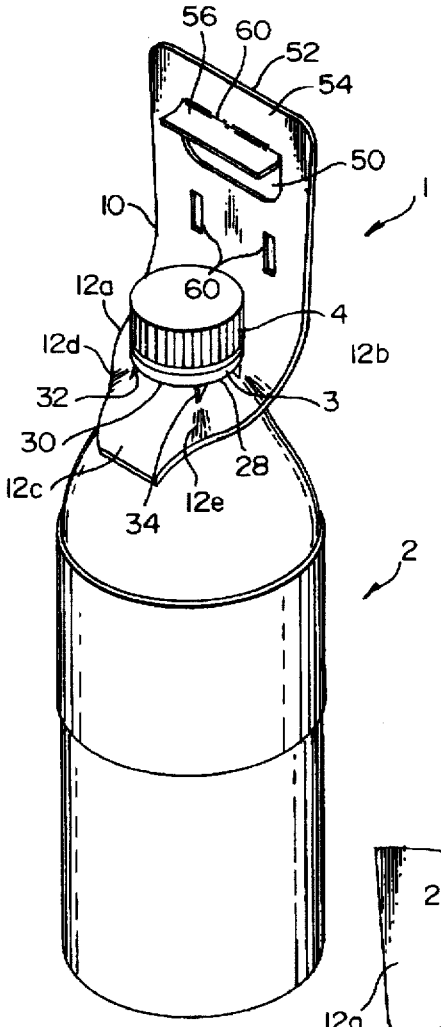
FIG. 1
FIG. 2A
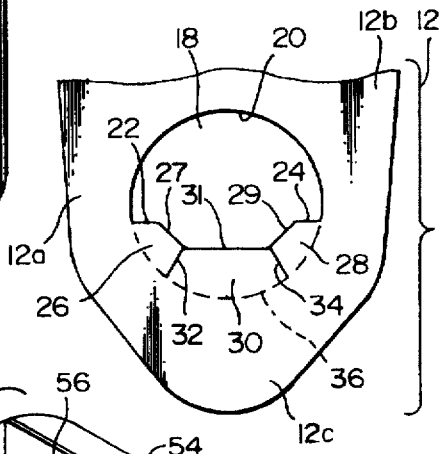
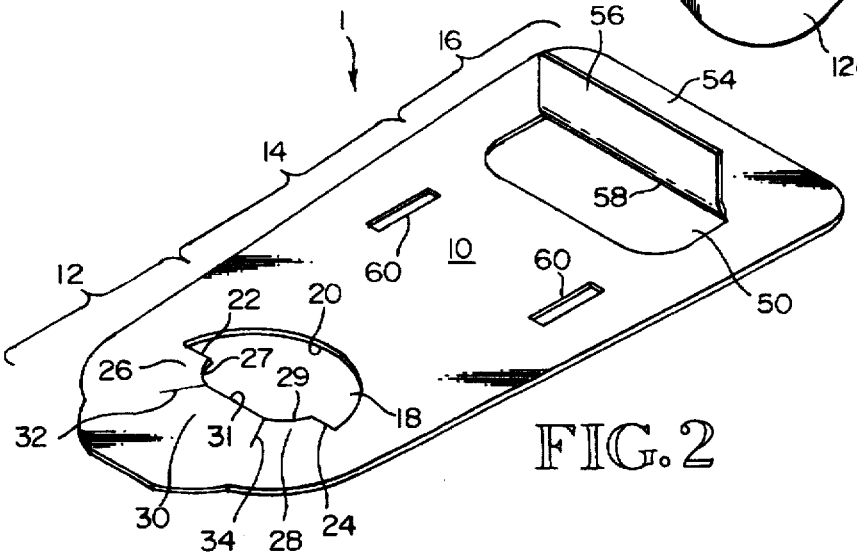
FIG. 2

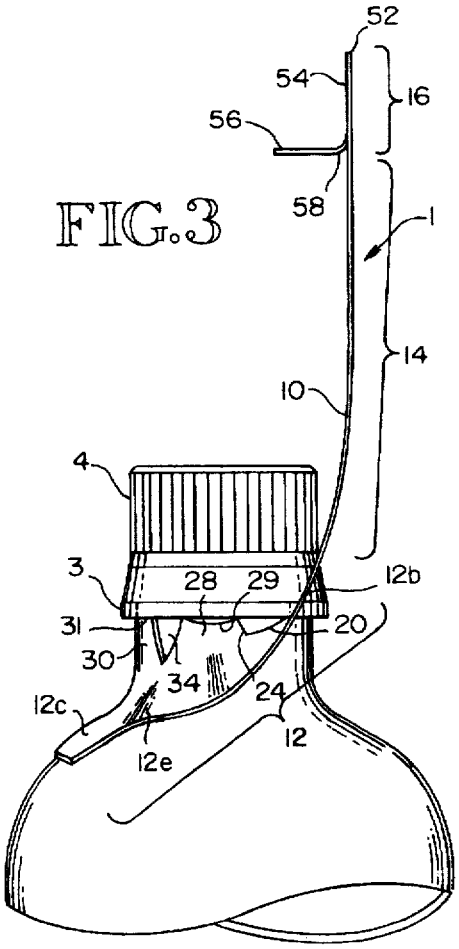
FIG. 3
FIG. 4
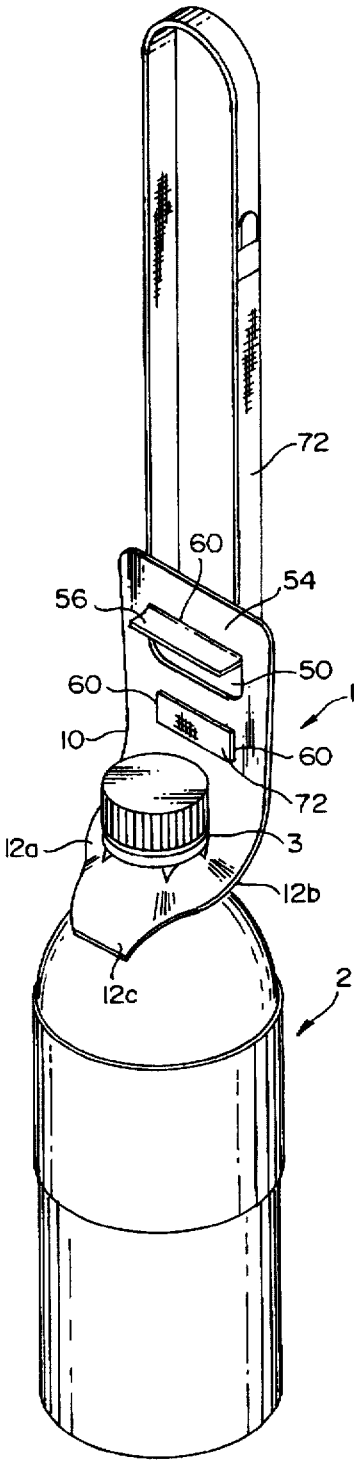
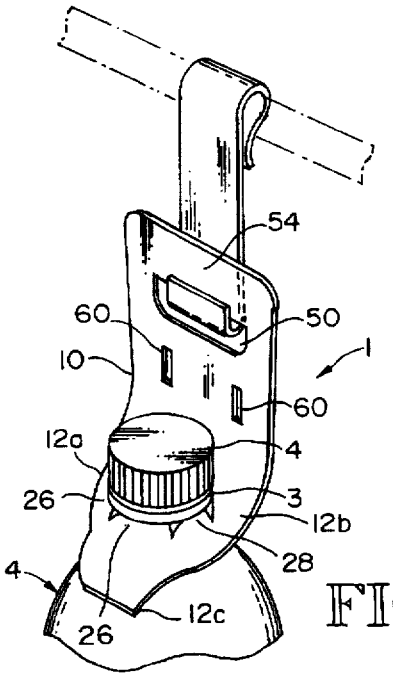
FIG. 5

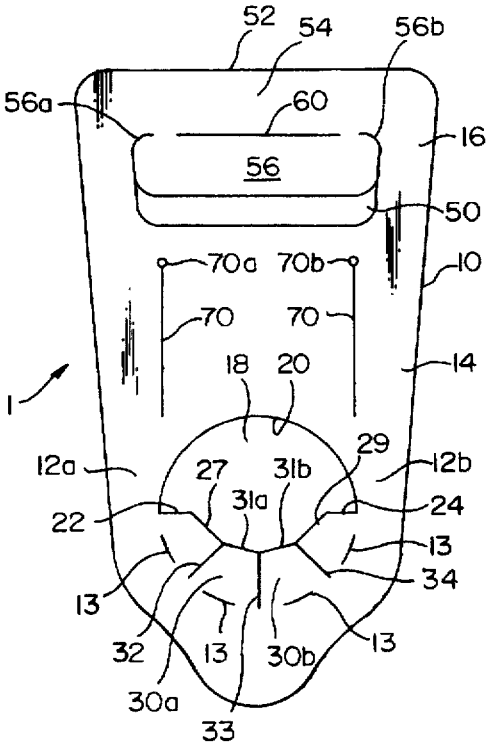
FIG. 10
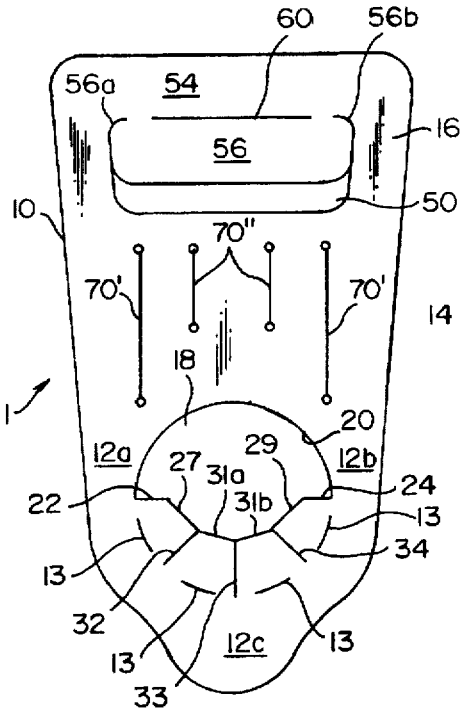
FIG. 13
FIG. 14
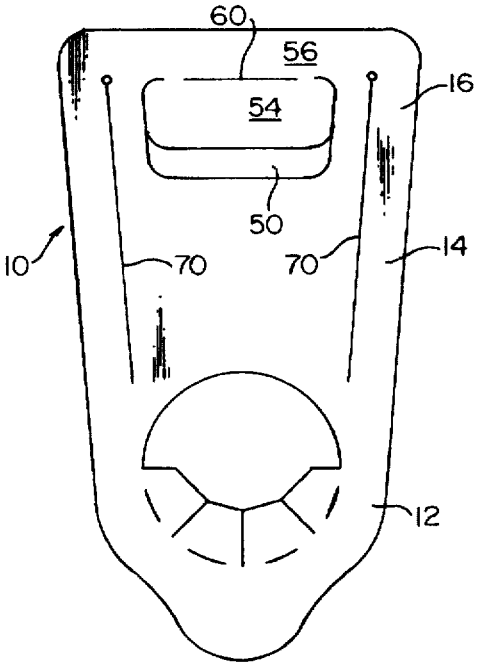
FIG. 15
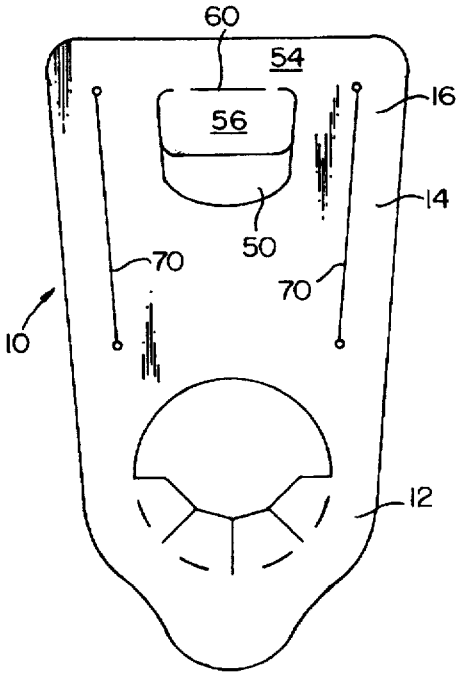

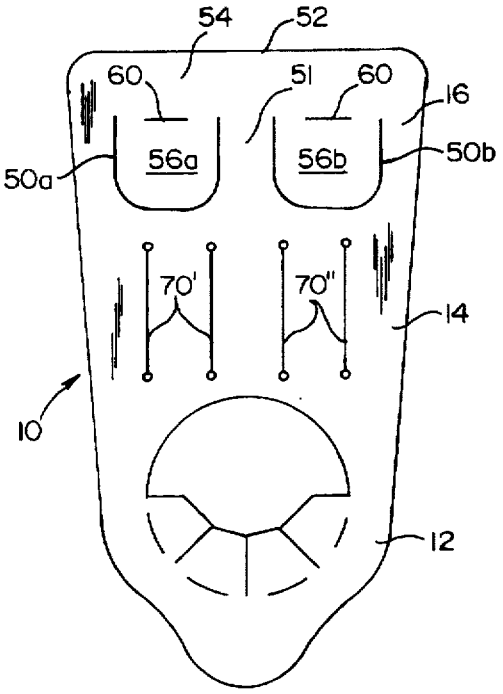
FIG. 16
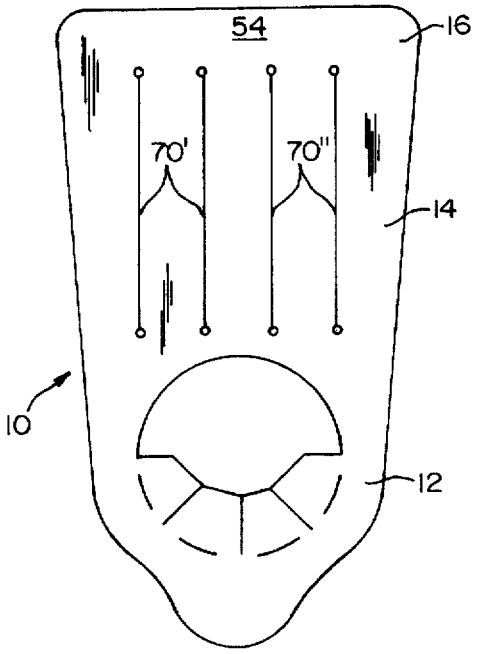
FIG. 17
FIG. 18
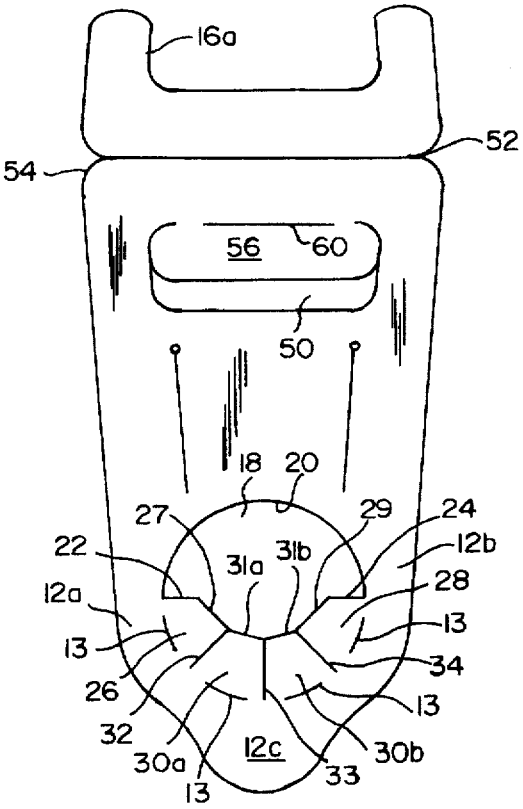
FIG. 19
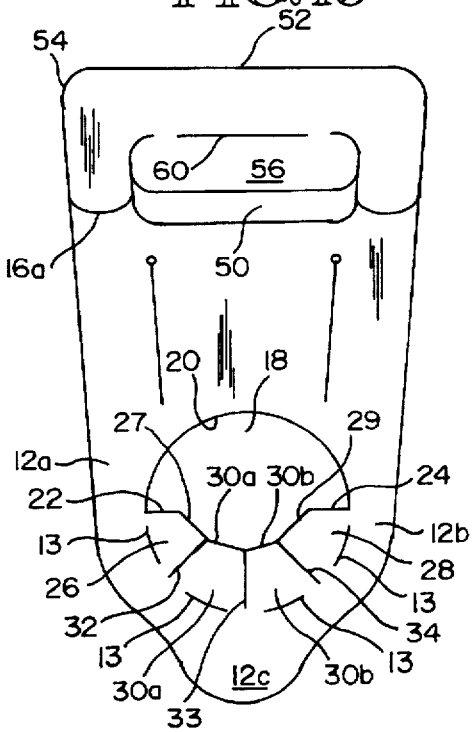

BOTTLE CARRIER

BACKGROUND OF THE INVENTION

1. Field of the Invention

This invention relates to bottle carriers, and more particularly to bottle carriers for carrying one or two soft-drink-type plastic bottles.

2. Brief Description of the Prior Art

Bottle carriers heretofore proposed for carrying soft-drink-type bottles have suffered a number of deficiencies. Some are cumbersome to manufacture and/or cumbersome to ship and store. Some are inconvenient to use, requiring an unusual degree of dexterity to assemble around a bottle. Some are not suitable for disposal and recycling along with plastic bottles. Some are not suitable for reuse by being removed from one bottle and applied to another bottle. Some are not suited to permitting a bottle to be easily removed from the carrier and then reattached to the carrier.

SUMMARY OF THE INVENTION

It is a primary object of the present invention to provide a bottle carrier that can be mass-produced from sheet material. Another object is to provide a thin strip-like bottle carrier for carrying one or two bottles by engaging the bottle or bottles around the bottle neck. A further object is to provide such a bottle carrier that can be carried by a person's fingers or worn on a person's belt or carried by a shoulder strap. Still another object is to provide such a bottle carrier that can be easily engaged to and removed from a bottle neck so that the carrier can be removed from one bottle and applied to another bottle. A still further object is to provide such a bottle carrier to which a bottle can be easily attached and removed so that a bottle can be conveniently removed from the carrier, for example so that its contents can be poured out, and then re-attached to the carrier.

In accordance with the objects of this invention, a bottle carrier for carrying at least one bottle of the type having a rim separating a bottle neck from a bottle cap comprises bottle engaging means providing an aperture for fitting over a bottle cap, the aperture being defined by an arcuate edge extending through an arc of at least 180°, a first side edge extending from a first end of the arcuate edge into the aperture, a second side edge extending from a second end of the arcuate edge into the aperture, and at least one intermediate edge extending across the aperture between the first and second side edges; and at least one intermediate tab extending toward the aperture and terminating in the intermediate edge. The intermediate tab is so constructed and arranged with respect to the first and second side edges that the intermediate tab can be flexed so as to enlarge the effective opening of the aperture so that a bottle can be inserted into the aperture. The intermediate tab is further constucted and arranged so that the intermediate edge can be contacted with the underside of a bottle rim so as to support a bottle when a bottle has been inserted into the aperture. The bottle carrier of this invention also comprises carrying means connected to the bottle engaging means so that a bottle inserted into the aperture can be lifted and carried by the bottle carrier.

BRIEF DESCRIPTION OF THE DRAWINGS

FIG. 1 is a perspective view of a bottle attached to a single-bottle embodiment of the bottle carrier of this invention;

FIG. 2 is a perspective view of the FIG. 1 bottle carrier;

FIG. 2A is a partial plan view of a portion of the FIG. 2 bottle carrier;

FIG. 3 is a partial side elevation view of the FIG. 1 bottle and bottle carrier combination;

FIG. 4 is perspective view of the FIG. 1 bottle and bottle carrier combination, illustrating the application of a shoulder strap to the bottle carrier;

FIG. 5 is a partial perspective view of the FIG. 1 bottle and bottle carrier combination, illustrating the application of a hook to the bottle carrier for securing the combination to a support, the support being shown in dotted line;

FIG. 10 is a top plan view of an exemplary bottle carrier according to this invention, providing a hand/finger grip and providing for application of a narrow belt to the bottle carrier;

FIG. 13 is a top plan view of a modification of the FIG. 10 bottle carrier, providing a hand/finger grip and providing for application of a belt or a strap to the bottle carrier;

FIG. 14 is a top plan view of a modification of the FIG. 10 bottle carrier, providing a narrower hand/finger grip and providing for application of a wide belt to the bottle carrier;

FIG. 15 is a top plan view of another modification of the FIG. 10 bottle carrier, providing a still narrower hand/finger grip and providing for application of a wide belt to the bottle carrier;

FIG. 16 is a top plan view of still another modification of the FIG. 10 bottle carrier, providing two finger grips and providing for application of a narrow belt to the bottle carrier;

FIG. 17 is a top plan view of a further modification of the FIG. 10 bottle carrier, eliminating the hand/finger grip and providing for application of a wide belt to the bottle carrier;

FIG. 18 is a top plan view of another embodiment of the bottle carrier of this invention, similar to the FIG. 10 embodiment but providing for reinforcement of the hand/finger grip;

FIG. 19 is a top plan view of the FIG. 18 bottle carrier embodiment with the reinforcement applied to the hand/finger grip;

DESCRIPTION OF THE PREFERRED EMBODIMENT

In its various embodiments, as hereinafter described, the bottle carrier comprises a thin, flexible strip having a width slightly larger than the width of the bottle to which is it to be applied, and having a length sufficient to extend far enough beyond the neck of the bottle that the bottle carrier can be gripped by a person's hand or fingers, or that the bottle carrier can be attached to a person's belt or to a shoulder strap. The bottle carrier is flexible enough that it can be easily and conveniently slipped over a bottle cap and down onto the bottle neck to attach a bottle to the bottle carrier. The bottle carrier of this invention has been designed to be inexpensively mass produced. It may be fabricated from thin sheet material such as 0.015 to 0.035 inch thick plastic sheet material in a die-stamping process. It is designed to be applied to the neck of a bottle, such as a soft-drink bottle, having an annular rim that separates the bottle neck from the bottle cap-engaging portion.

A key feature of the bottle carrier is the provision of an aperture having a special peripheral configuration for fitting over a bottle cap and onto a bottle neck and for seating against the underside of the bottle neck/cap separating rim. Whatever material is selected for the bottle carrier, that material must be sufficiently flexible that the aperture peripheral elements may flex sufficiently to enable the bottle carrier to be applied to a bottle and to engage the bottle's rim. Any material that would permit such flexing would most likely be suitable. The bottle carrier may be fabricated from various types of thin material such as plastics, plasticized paper, flexible cardboard, and the like. Suitable plastics could be high density polyethylene, nylon, polypropylene, and the like.

In a preferred form of the invention, the bottle carrier is likewise flexible enough that it can be easily and conveniently slipped from the neck of a bottle and over the bottle cap to remove the bottle from the bottle carrier. This may be desirable to enable the bottle carrier to be switched from one bottle to another, or to permit the bottle to be removed, so that its contents may be poured out, and then re-attached to the carrier. For such use, the material from which the bottle carrier is fabricated must be sufficiently resilient and have sufficient elastic memory to enable the peripheral elements of the bottle carrier's aperture to be flexed repeatedly.

Figure 6:
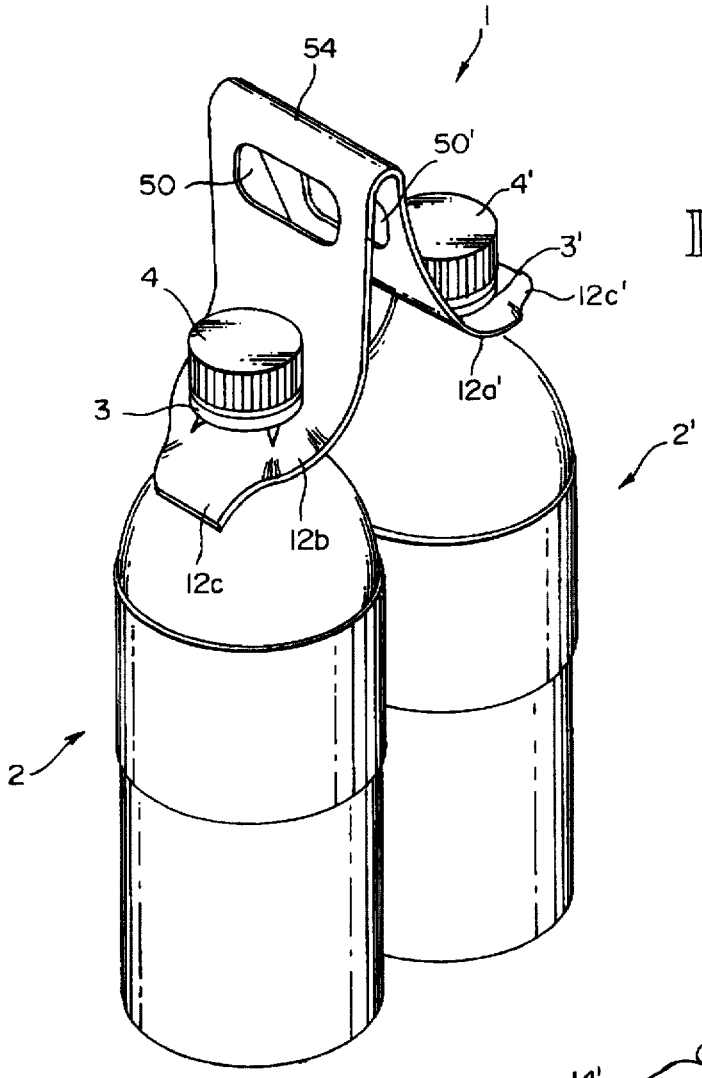
FIG. 6 is a perspective view of two bottles attached to a double-bottle embodiment of the bottle carrier of this invention.

The bottle carrier 1 of this invention comprises a thin flexible strip 10 that is provided with a bottle-engaging portion 12, a mid-portion 14, and a carrying portion 16. The bottle-engaging portion 12 contains an aperture 18 having a special periphery configured with certain peripheral elements designed to engage the bottle carrier 1 with a bottle 2. Whether the bottle carrier 1 is designed to carry a single bottle, such as shown in FIG. 1 and elsewhere, or to carry two bottles, such as shown in FIGS. 6 and 8, each bottle-engaging portion 12 thereof will have an aperture 18 for each bottle and each aperture 18 will have the special periphery with the aforesaid peripheral elements. In FIGS. 6–9, where two bottle engaging portions are illustrated, duplicate elements are numbered by the same numerals primed; e.g. apertures 18 and 18'.

The bottle-engaging portion 12, as more specifically illustrated in FIG. 2A, is provided with at least one aperture 18 and its peripheral aperture elements during the fabrication of the bottle carrier. As seen in FIG. 2A, aperture 18 comprises a semi-circular portion bounded by a semi-circular edge 20 that circumscribes an arc of at least 180°, two opposed side edges 22, 24 that extend inward from each end of the semi-circular edge 20 toward one another, a side bottle rim-engaging tab 26 adjacent to side edge 22, a second side bottle rim-engaging tab 28 adjacent to side edge 24, and at least one intermediate bottle rim-engaging tab 30 between tabs 26 and 28. Tab 26 has a peripheral edge 27 that intersects side edge 22 and extends at an obtuse angle away from edge 22 toward an intermediate edge 31. Tab 28 has a peripheral edge 29 that intersects the other side edge 24 and extends at an obtuse angle away from edge 24 toward intermediate edge 31. Intermediate tab 30 has peripheral edge 31 that intersects both edges 27 and 29 at obtuse angles. The intermediate tab 30 is separated from side tabs 26 and 28 by slits 32, 34, respectively. Slit 32 extends away from aperture 18 so as to approximately bisect the angle included between edges 27 and 31. Slit 34 extends away from aperture 18 so as to approximately bisect the angle included between edges 29 and 31.

Slits 32 and 34 are long enough that an arc transcribed through their outer ends would have a radius at least as great as the radius of semi-circular edge 20. As seen in FIG. 2A, a circular arc 36, transcribed through the outer ends of slits 32 and 34, is shown in dotted line extending from the ends of semi-circular edge 20. Because the radius of transcribed arc 36 is at least as great as the radius of semi-circular edge 20, the effective opening of aperture 18 has a width in all directions at least as great as the largest distance across aperture 18. Therefore, when a bottle cap and neck are slipped through aperture 18 to achieve the result illustrated in FIG. 1, the effective width of the aperture 18 will reach out to the ends of slits 32 and 34. If that effective width is at least as great as the diameter of the bottle neck/cap separating rim 3, as it must be, then the bottle cap 4 and rim 3 may be successfully inserted through aperture 18. It is preferred, however, that slits 32 and 34 be extended sufficiently that the transcribed arc 36 will have a radius that increases from the ends of semi-circular edge 20 to the midpoint of arc 36. Consequently, the effective shape of aperture 18 will be somewhat oblong.

Figure 20:
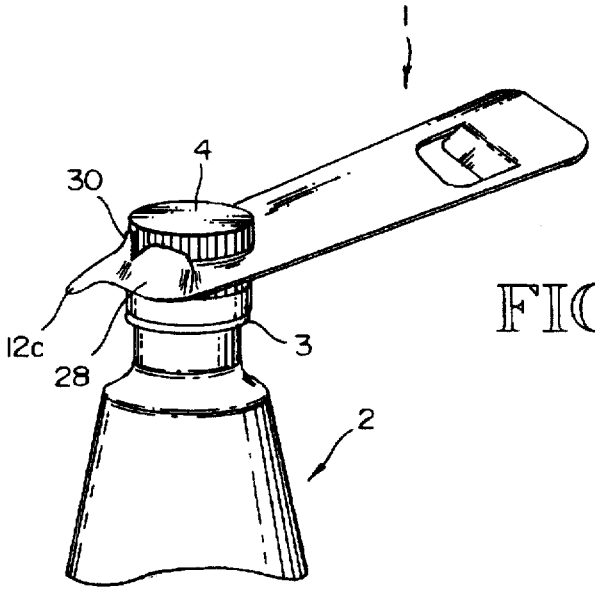
FIG. 20 is a partial perspective view of the bottle carrier of this invention and a single bottle, as the bottle carrier would appear when being applied to the neck of a bottle.
Figure 21:
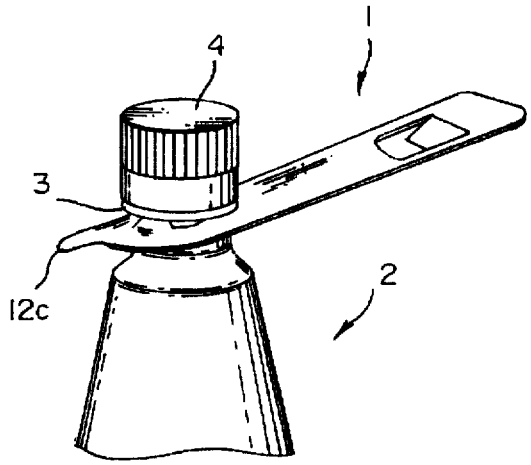
FIG. 21 is a partial perspective view of the FIG. 20 bottle carrier and bottle combination, as the bottle carrier would appear just after being applied to the neck of a bottle.
Figure 22:
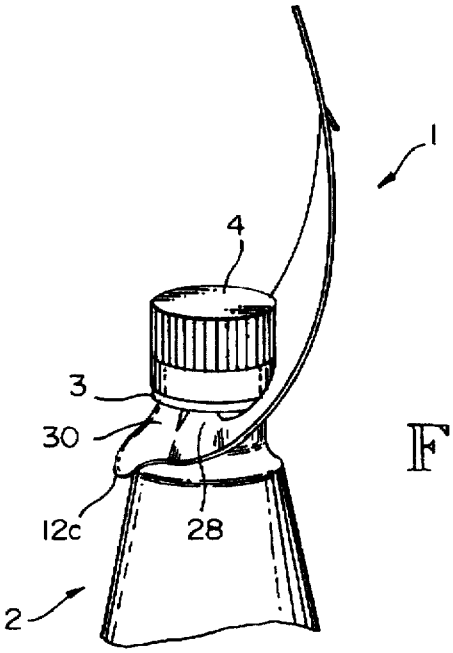
FIG. 22 is a partial perspective view of the FIG. 20 bottle carrier and bottle combination, as the bottle carrier would appear in its carrying position with the bottle suspended therefrom

In a preferred configuration of the FIG. 2A aperture 18, a diameter for the semicircular edge 20 of 1¼ inches would be suitable for fitting over the cap/neck separating rim 3 of a standard 12 oz. plastic soft drink bottle. For this size, edges 22 and 24 would preferably be ⅛ inch long (which is about the width of the standard bottle rim 3), edges 27 and 29 would preferably be ¼ inch long, edge 31 would preferably be ½ inch long, slits 32 and 34 would preferably be ¼ inch long, and the arc circumscribed by edge 20 would be on the order of 200°. This configuration, locates edges 22 and 24 beyond the center point of the circumscribed arc of edge 20 so that edges 22 and 24 are not diametrical. Edge 31 is preferably parallel to edges 22 and 24. Relative to tab 30, slits 32 and 34 are preferably oriented at about 117° to edge 34; relative to tabs 26, 28, slits 32 and 34 are preferably oriented at about 110° to their respectively-adjacent edges 27, 29; and, thus, slits 32 and 34 only approximately bisect the angles included between edges 27, 31 and 29, 31. Edges 27 and 29 may be slightly curved so as to be slightly concave. Referring now to FIGS. 1, 2, 2A, 3 and 20–24 to illustrate how aperture 18 and its peripheral elements function, the process involved in applying the bottle carrier 1 places aperture 18 axially above the bottle cap 4 and then slips the bottle engaging portion 12, that contains aperture 18, over the bottle cap 4 so that cap 4 protrudes through aperture 18. As seen in FIG. 20, the peripheral elements comprised of tabs 26, 28 and 30 are deflected upward as the bottle carrier 1 is pulled down over the bottle cap 4, and the tab edges bounded by slits 32, 34 are spread apart so that the effective size of aperture 18 expands to the full length of slits 32 and 34. When the bottle cap 4 and neck/cap separating rim 3 have cleared aperture 18, as seen in FIG. 21, the edges of the flexible tabs 26, 28 and 30 slip under the bottle rim 3 as the flexible tabs approximately return to their original positions so that edges 27, 29 and 31 underlay rim 3. Thus, when the carrying portion 16 of bottle carrier 1 is lifted up, as seen in FIG. 22, so that the weight of bottle 2 and its contents begins to be transferred to bottle carrier 1, tabs 26, 28 and 30 are deflected upward so that their respective edges 27, 29 and 31 contact the underside of bottle rim 3. Furthermore, as the bottle carrier 1 is lifted to the position seen in FIG. 22, the edges 22 and 24, at the ends of arcuate edge 20 are also raised and turned upward into contact with the underside of bottle rim 3. Consequently, the bottle 2 may be lifted clear of its base support and be completely supported by edges 22, 24, 26, 28 and 30. In the position shown in FIGS. 1 and 22, the arcuate edge 20 extends upward from each of its ends alongside the bottle cap 4 and around the side of the bottle cap that is diametrically opposite to tab 30. Because edges 22, 24, 26, 28 and 30 underlay bottle rim 3, the midpoint of arcuate edge 20 does not clear the top of the bottle cap and, therefore, arcuate edge 20 supports the side of the bottle cap 3 opposite to tab 30 and stabilizes the bottle 2 in an upright position as the bottle carrier 1 lifts the bottle 2.

When the carrying portion 16 of the bottle carrier 1 is lifted to shift the position of the bottle carrier from the position seen in FIG. 21 to the lifting position seen in FIGS. 1 and 22, the carrier mid-portion 14 flexes into a vertically-concave configuration facing the bottle 2 and this concavity extends into the bottle engaging portion 12 of strap-like side sections 12*a* and 12*b* alongside the arcuate edge 20. Consequently, edges 22 and 24 are pivoted into contact with the underside of the bottle rim 3. As arcuate edge 20 is drawn around the bottle cap 4, during the lifting of the bottle carrier 1 from the FIG. 21 position to the position shown in FIGS. 1, 22, the edge 31 of tab 30 is brought up against the underside of bottle rim 3. Tabs 26, 28 and 30 assume complex curved configurations, assuming vertically-concave configurations facing outward and also horizontally-convex configurations around the bottle neck. By "vertically-concave" it is meant that the concave curvature is oriented generally upright, whereas by "horizontally-convex" it is meant that the convexity is oriented generally horizontally around the bottle neck. A section 12*c* of the bottle engaging portion 12, below tab 30 as seen in FIGS. 1 and 3, assumes a curved configuration that generally conforms to the surface of the bottle neck; however it may be somewhat horizontally-concave between the transitions sections 12*d*, 12*e* so as to tend to bow outward.

When the carrying portion 16 of the bottle carrier 1 is lifted, sections 12*d* and 12*e* respectively radiate downward from slits 32 and 34 and assume convex ridge-like configurations that form transitions between the curved section 12*c* and the concave side sections 12*a* and 12*b*. Viewed from the perspective of FIG. 3, it is seen that the external edge of bottle engaging section 12 is concave upward in the regions of the side sections 12*a*, 12*b*, and makes a transformation through transition sections 12*d*, 12*e* to become convex upward through section 12*c*. The transition sections 12*d*, 12*e* may generally conform to the surface of the underlaying bottle curvature, as seen in FIG. 3, or -depending on the relative structures of the aperture peripheral elements and the bottle neck - may assume a ridge-like buckled appearance. In general, if the transition sections 12*d*, 12*e* generally conform to the underlaying bottle curvature, the section 12*c* will also generally conform to the underlaying bottle curvature. If the transition sections 12*d*, 12*e* have a buckled appearance, however, it is likely that the section 12*c* will be horizontally-concave between the transition sections.

When the carrying portion 16 of the bottle carrier 1 is lifted, slits 32, 34 separate so that the tabs 26, 28 and 30 can bend around the bottle neck in horizontally-convex configurations, thereby bringing their respective circumferential edges 27, 29 and 31 into abutment with the underside of bottle rim 3 essentially along their entire lengths, as seen in FIGS. 1 and 22. Edges 27 and 29 may be slightly curved to ensure that they are brought into full abutment with the underside of the bottle rim 3.

Figure 11:
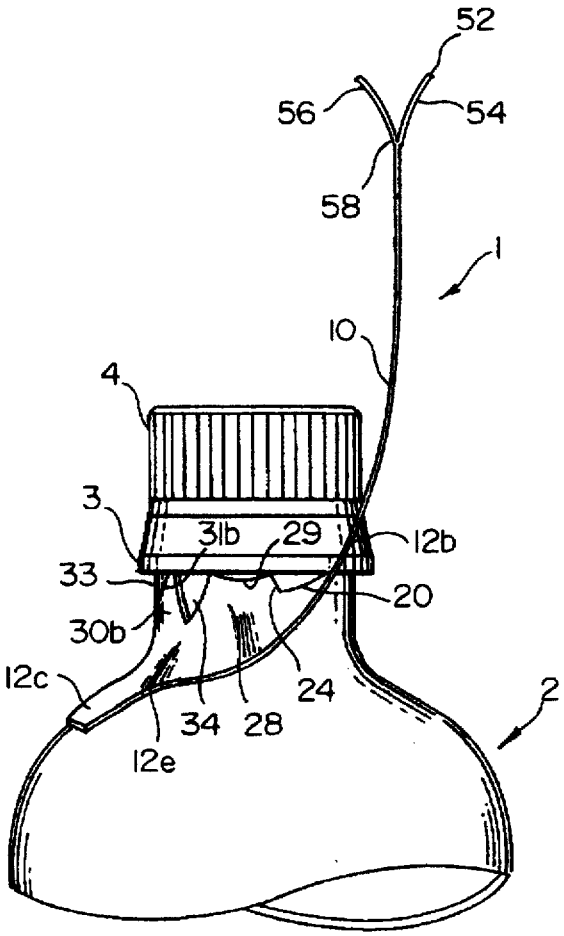
FIG. 11 is a partial side elevation view of the FIG. 10 bottle carrier applied to a single bottle.
Figure 12:
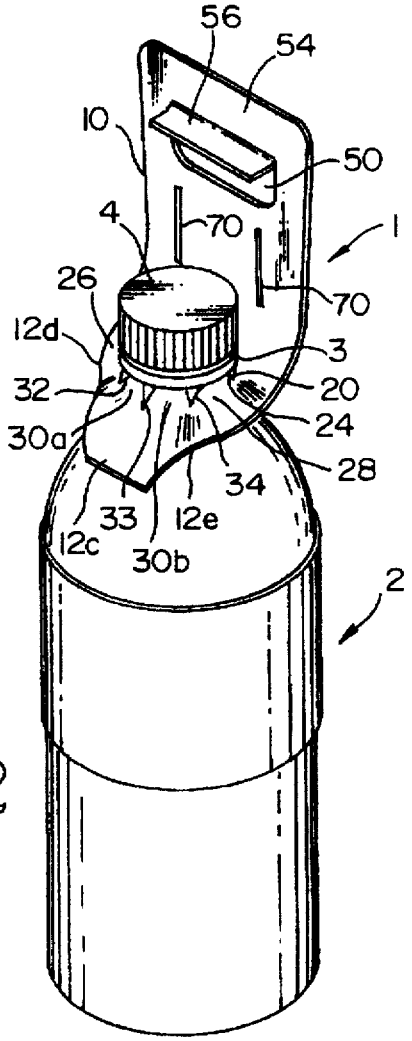
FIG. 12 is a perspective view of the FIGS. 10–11 bottle carrier applied to a single bottle.

In order to provide a better fit between the edge 31 of intermediate tab 30 and the underside of the bottle rim 3, particularly in the case of larger bottles such as 1½ liter bottles where aperture 18 might have a nominal diameter of 1¼ inches, and as seen in FIG. 10 and other Figures, the intermediate tab may be bifurcated into two tabs 30*a*, 30*b*, separated by a third, center slit 33. Instead of one intermediate edge 31, as seen in FIG. 2A for example, two intermediate edges 31*a* and 31*b* would be provided and these two edges could be askew of one another by a few degrees as seen in FIG. 10. For this embodiment, particularly for use with the larger-sized bottles, slits 32 and 34 could be ⅜ inch long and the center slit 33 could be ½ inch long, thereby accentuating the oblong character of the effective shape of aperture 18. By providing an additional slit 33, particularly for use with the larger-sized bottles, the aperture 18 can expand more readily and the edges 31*a* and 31*b* will better fit the underside of rim 3 as seen in FIGS. 11 and 12. With the additional center slit 33, the section 12*c* of the bottle-engaging portion 12 will conform better to the shape of the underlaying bottle neck and transition sections 12*d*, 12*e* will also more closely conform to the underlaying bottle neck.

Side sections 12*a* and 12*b* must have a sufficient width to transfer the weight of the bottle and its contents without twisting or collapsing. A minimum width, opposite edges 22 and 24, of about ½ inch has been found to be sufficient. A width between slits 32 and 34, and slit 33 if provided, and the nearest exterior edge of section 12*c* of about ½ inch has also been found to be sufficient.

To enhance the expandability of aperture 18 to its full effective size when a bottle is inserted through it, the material from which the bottle carrier 1 is fabricated may be provided with crease lines 13 at the base of each tab as shown in FIG. 10. Crease lines of about ¼ inch long have been found sufficient. Such crease lines may be particularly helpful if the material from which the bottle carrier 1 is fabricated may be prone to ripping or tearing. The presence of the crease lines 13 minimizes the likelihood that one or more of the tab-separating slits 32, 34, and 33 if present, may be inadvertently torn toward the external edge of section 12*c* of the bottle engaging portion 12 as the bottle cap 4 is forced through aperture 18. Crease lines 13 define the outline of the effective width of aperture 18 at the base of the tabs; showing with respect to FIG. 10, for example, that the effective shape of aperture 18 may be somewhat egg shaped.

Whether the effective shape of aperture 18 is generally circular as seen in FIG. 2A, or oblong, or egg-shaped as seen in FIG. 10, the width of the aperture's opening as bounded by arcuate edge 20 must be great enough to fit over the bottle cap that is to be inserted through that opening, edges 22 and 24 must be long enough to engage the underside of the bottle rim 3, and the effective shape of the aperture in the region of the bases of the tabs must be great enough that the tabs can slide down around the bottle cap and underlay the bottle rim. Moreover, although the width of the aperture's opening across the ends of arcuate edge 20 must be at least as large as the diameter of the bottle cap that is to be inserted through that opening, the width of the opening between the mid-point of edge 20 and intermediate tab edge 31 (or tab edges 31*a*, 31*b*), must be less than the diameter of the bottle cap. It appears to be important to the working structure of the bottle carrier 1 (a) that the structure include side edges 22, 24 to underlay and contact the bottle rim 3 on opposite sides of the bottle, (b) that intermediate tab 30 with edge 31 (or intermediate tabs 30*a*, 30*b* with edges 31*a*, 31*b*) bear against the front of the bottle neck approximately midway between edges 22, 24 so that the intermediate edge 31 (or edges 31*a*, 31*b*) will underlay and contact the bottle rim midway between edges 22, 24, (c) that the width between intermediate edge 31 (or edges 31*a*, 31*b*) and the midpoint of arcuate edge 20 be less than the diameter of bottle cap 4, and (d) that the effective size and shape of the aperture 18—when the aperture's peripheral elements are bent to accommodate insertion of the bottle cap, as seen in FIG. 20 for example—be sufficient to permit the bottle cap to pass through.

The carrying portion 16 of the bottle carrier 1 may be designed so that the bottle carrier may be carried by a user's finger or fingers, or by being attached to a strap or a user's waist belt, or by being attached to some sort of fastener such as a peg or a hook. All of the Figures, except FIG. 17, illustrate the bottle carrier 1 provided with a carrying portion 16 designed to accommodate one or more of the user's fingers. FIG. 17 illustrates a version designed to accommodate a belt only. In the versions designed to accommodate a user's finger or fingers, the carrying portion 16 is cut out to provide a narrow transversely-elongated finger aperture 50 between the upper transverse edge 52 of the bottle carrier 1 and the mid-portion 14. The width between the aperture 50 and the outer transverse edge 52 is sufficient to provide a handle 54 for the carrier 1. During the fabrication process, a flap 56 may be severed from the aperture 50, leaving a transverse portion integrally-connected to the handle 54 along the top of the flap. Consequently, the flap 56 may be bent upward toward the handle 54 to provide a turned edge 58 at the bottom of the handle 54 as seen in FIGS. 3 and 11. The double thickness of the handle 54 and the flap 56, combined with the turned edge 58, will provide a comfortable carrying edge for the user when carrying a bottle 1—particularly when carrying larger-sized bottles such as 1½ liter bottles. Because the bottle carrier 1 can be fabricated from relatively thin material, the provision of the turned edge 58 will prevent the bottom edge of the handle 54 from cutting into the user's fingers. In fabricating the flap 56, the upper ends are preferably rounded, as at 56a and 56b (as seen in FIG. 10) so that the upper edges of the aperture 50 will not be prone to tearing out. To facilitate bending the flap 56 upward against the handle 54, a crease line 60 may be added during manufacture; a crease line of about ¾–1 inch long being found sufficient. It has been found sufficient to provide the flap with a width of about ½ inch and to provide the aperture 50 with a width of about ¾–1 inch. The transverse length of aperture 50 may be long enough for one, two or more fingers; FIG. 10 illustrating a two or three finger length; FIG. 14 illustrating a two finger length; FIG. 15 illustrating a one finger length; and FIG. 16 illustrating two discrete one-finger length apertures 50*a*, 50*b* separated by a vertical web 51. The bottom edge of the aperture 50 may be variously configured as seen in the various Figures. The flap 56 typically extends only part way into the aperture 50, usually about ½–⅔, although it may extend completely across the aperture 50, as seen in FIG. 16 with respect to the double apertures 50*a* and 50*b* and the double flaps 56*c*, 56*d*.

Where the bottle carrier 1 is to be provided with both a finger/hand grip 54 and a provision for being carrier on a belt or a strap, the mid-portion 14 is the likely location for placement of longitudinal slits for a belt or strap. FIGS. 1, 2 and 5 illustrate the provision of strap notches or cut-outs 60 located in the mid-portion 14. A preferred provision for carrying the bottle carrier 1 on a waist belt or on a strap, however, would be to provide slits 70 in the mid-portion 14. FIGS. 10–17 illustrate various arrangements of slits 70. In FIG. 10, for example, a pair of waist belt slits 70 are illustrated that might be suitable for a belt or strap up to about 1¼ inch wide. Such a belt or strap would be inserted through both of the slits, much like that shown in FIG. 4 with respect to a shoulder strap 72. FIG. 13 illustrates the provision of one pair of slits 70' for a belt and another pair of slits 70" for a strap. FIGS. 14 and 15 illustrates a pair of longer slits 70 that extend across the mid-portion 14 and up into the carrying portion 16, on either side of the finger aperture 50, for a wide belt on the order of up to about 2⅜ inches. FIG. 16 illustrate two pairs of slits 70', 70" for a strap and FIG. 17 illustrates two pairs of slits 70', 70" for a belt. Where slits are applied for a belt or a strap, the upper edges of the slits, as at 70*a* and 70*b* in FIG. 10, are preferably fabricated with small, round terminating holes, about ⅛ inch in diameter, to prevent ripping or tearing out of the slits. Also, as shown in FIG. 13, the bottom edges of belt and/or strap slits may be fabricated with small, round terminating holes for the same reason.

Referring now to FIGS. 6–7 and 8–9, the bottle carrier of this invention may be provided in versions that can carry two bottles. The FIGS. 6–7 version illustrates a bottle carrier version where two opposed bottle engaging portions 12, 12' are joined by a common carrying portion 16 with a common handle 54 and two finger apertures 50, 50' and two flaps 56, 56'. The FIGS. 8–9 version illustrates a bottle carrier version where two opposed bottle engaging portions 12, 12' are joined by separate carrying portions 16, 16', each carrying portion having its own handle 54, 54', finger aperture 50, 50' and flap 56, 56'. In the FIGS. 6–7 version, the common carrying portion will reside between and above two bottles that are lifted by the carrier as shown in FIG. 6 so that, in effect, the FIGS. 6–7 version functions like two of the FIG. 1 carriers joined together along the FIG. 1 handle edge 52 (illustrated in FIG. 7 by dashed line 53). In the FIGS. 8–9 version, however, the two carrying portions 16, 16' extend outward from one another at right angles to the bottle engaging portions 12, 12', the two bottle engaging portions 12, 12' and the two carrying portions 16, 16' being interconnected by an integral central web 15. Both two-bottle versions of FIGS. 6–9 show the structure of the aperture and its peripheral elements illustrated in FIG. 2A. However, either or both of the FIGS. 6–9 versions could equally well be provided with the structure of the aperture and its peripheral elements illustrated in FIG. 10 where a single intermediate tab has been replaced with two intermediate tabs 30*a*, 30*b* and a single intermediate edge has been replaced with two intermediate edges 31*a*, 31*b*.

As in the case of the FIGS. 1 and 10 versions, with respect to the FIGS. 6–9 versions, whether the effective shape of apertures 18, 18' is generally circular or oblong or egg-shaped, the width of the apertures' openings as bounded by arcuate edge 20, 20' must be great enough to fit over the bottle cap that is to be inserted through that opening. Edges 22, 22' and 24, 24' (24' not being shown in FIGS. 8–9) must be long enough to engage the underside of the respective bottle rim 3, 3'. The effective shape of the aperture in the region of the bases of the tabs must be great enough that the tabs can slide down around the bottle caps and underlay the bottle rims. Moreover, although the width of the apertures' openings across the ends of arcuate edge 20, 20' must be at diameter of these the diameter of the respective bottle caps that are to be inserted through those openings, the widths of the openings between the mid-point of edges 20, 20, and intermediate tab edges 31, 31', must be less than the diameters of the bottle caps. It appears to be important to the working structure of the bottle carrier (a) that the structure include side edges 22, 22', 24, 24' to underlay and contact the bottle rims 3, 3' on opposite sides of each bottle, (b) that intermediate tabs 30, 30' with edges 31, 31' bear against the front of the bottle necks approximately midway between edges 22, 22', 24, 24' so that the intermediate edges 31, 31' will underlay and contact the bottle rims midway between edges 22, 22', 24, 24', (c) that the widths between intermediate edges 31, 31' and the midpoints of arcuate edges 20, 20' be less than the diameters of bottle caps 4, 4', and (d) that the effective size and shape of the apertures 18, 18'—when the apertures' peripheral elements are bent to accommodate insertion of the bottle caps—be sufficient to permit the bottle caps to pass through.

Figure 7:
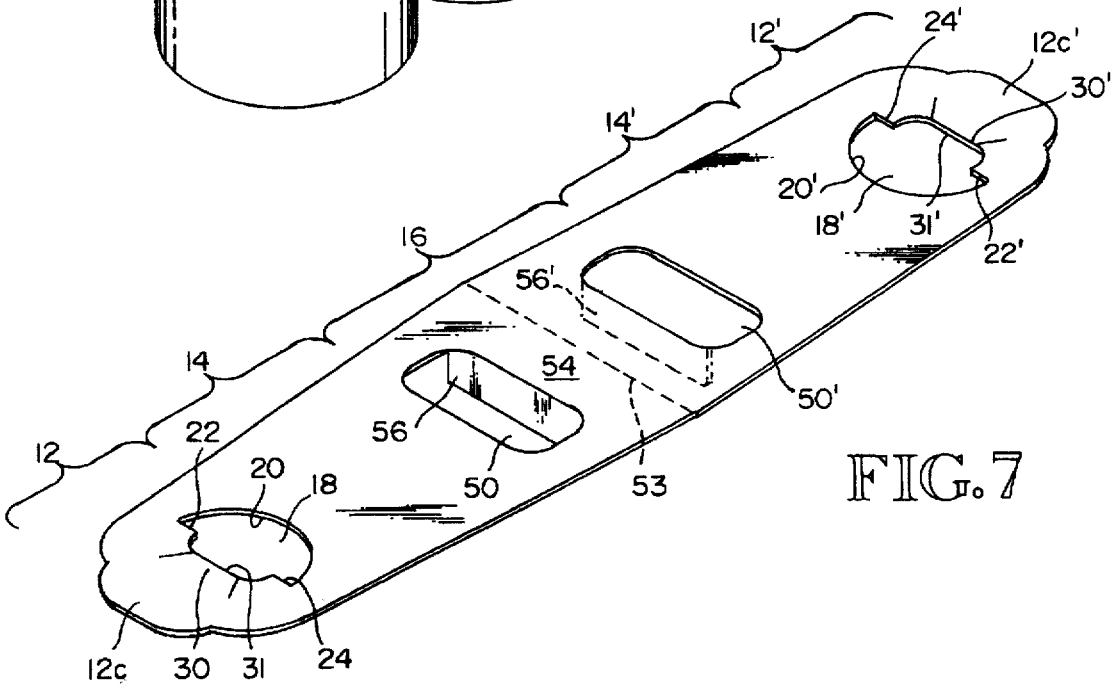
FIG. 7 is a perspective view of the FIG. 6 bottle carrier.
Figure 8:
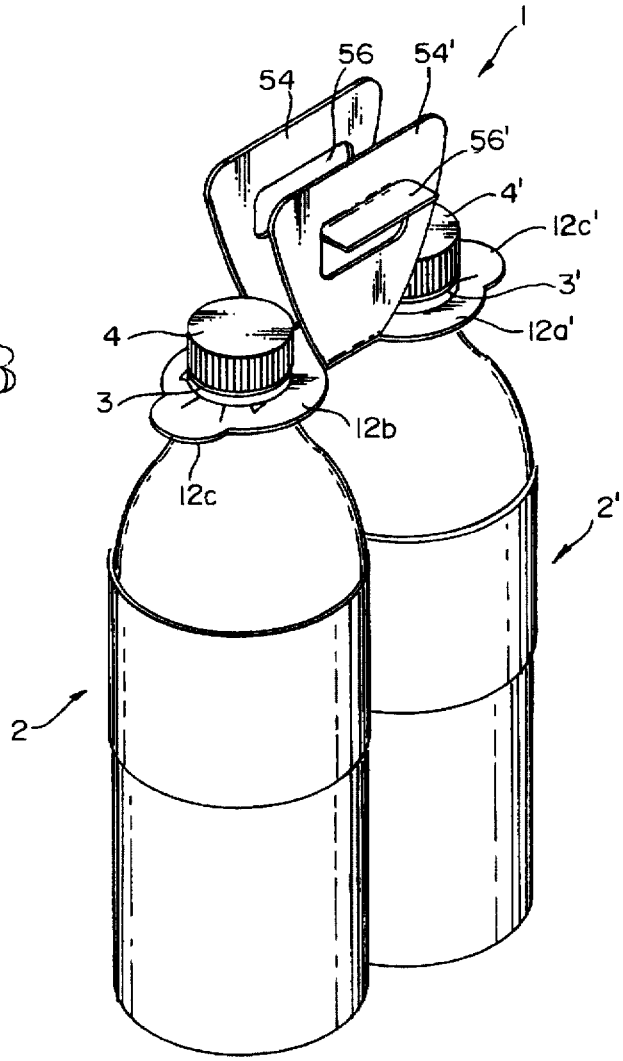
FIG. 8 is a perspective view of two bottles attached to another double-bottle embodiment of the bottle carrier of this invention.
Figure 9:
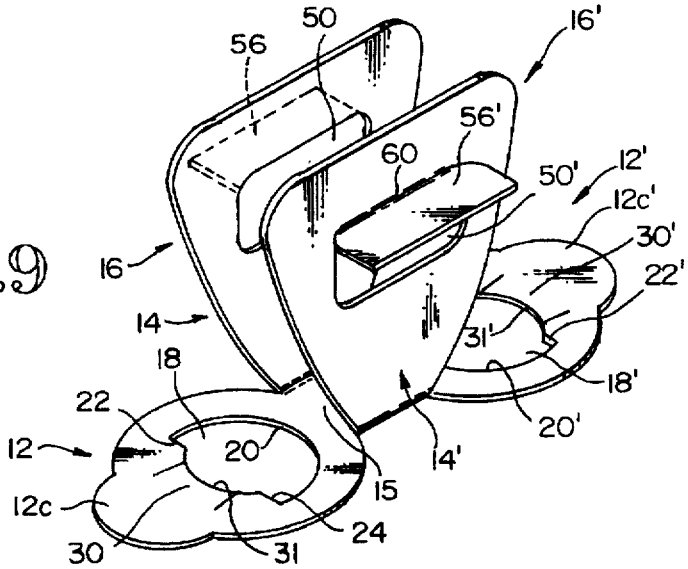
FIG. 9 is a perspective view of the FIG. 8 bottle carrier.

In the carrying portion of the FIGS. 6–7 version, the handle flaps 56, 56' preferably extend inward toward one another when lifting bottles so that the two flaps will overlap to provide additional finger support for the user. In the carrying portion of the FIGS. 8–9 version, the handle flaps 56, 56' preferably extend outward away from one another when lifting bottles so that the two flaps provide a separate turned edge for each finger aperture 50, 50'.

In addition to illustrating two distinct versions of two-bottle carriers, FIGS. 6 and 8 further illustrate the positions that the bottle engaging portions will assume during use. For example, both bottle engaging portions 12, 12' in FIG. 8 depict how they might appear just after having been installed onto their respective bottle necks, similar to what is shown in FIG. 21. The bottle engaging portion 12 in FIG. 6 illustrates how it might appear after the carrier has been lifted to lift its bottle 2, with section **12*c* overlaying the bottle curvature as previously described, similar to what is shown in FIG. 22. The bottle engaging portion 12' in FIG. 6, however, illustrates how it might appear after the section 12*c*' has been raised up and away from the neck of bottle 2' in preparation for removing bottle 2' from the carrier. The ability to remove a bottle, such as bottle 2', from the bottle carrier of this invention is an important feature of the invention. This feature will now be described in conjunction with FIG. 6 and FIGS. 23–24**.

Figure 23:
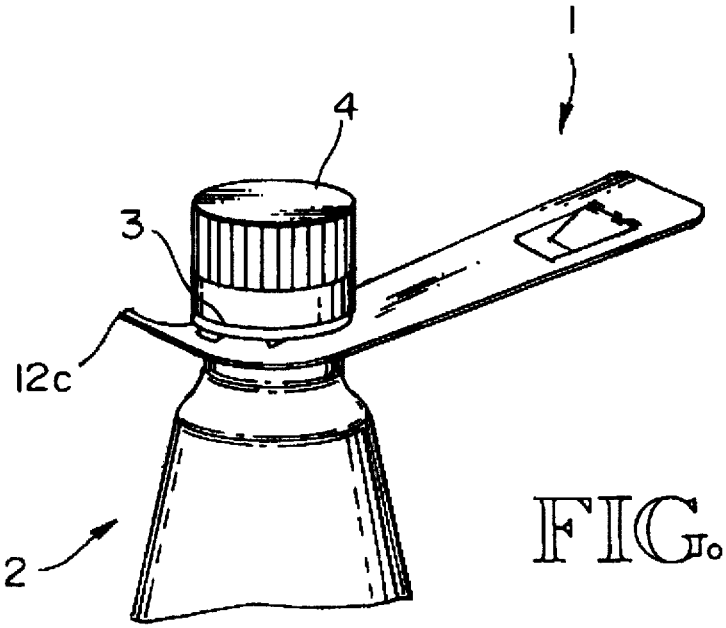
FIG. 23 is a partial perspective view of the FIG. 20 bottle carrier and bottle combination, as the bottle carrier would appear just after it had carried a bottle but before it was removed from the bottle.

When it is desired to remove a bottle from a bottle engaging portion 12 or 12' after the bottle has been installed and lifted by the bottle carrier, the stress of lifting forces and the weight of the bottle and its contents must be relieved from the bottle engaging portion. This stress relief may be accomplished by lowering the bottle onto a support surface so that the bottle carrier is no longer supporting the bottle, as seen in FIG. 23. Alternately, even when the bottle carrier is carrying another bottle as seen in FIG. 6, or when the bottle carrier is attached to a belt or strap and consequently cannot be released so as to assume the relaxed position seen in FIG. 23, the bottle to be released can be shifted upward to relieve the bottle carrier of stress due to the weight of the bottle and its contents. Therefore, whether the bottle is supported from below so that the bottle carrier can be relaxed as shown in FIG. 23, or the bottle is raised to relieve its encircling bottle carrier bottle engaging portion, 12 or 12', the section **12*c*, or 12*c*', may be lifted from its downward position (as shown in FIG. 22, or as shown in FIG. 6 with respect to section 12*c*) to a generally horizontal position (as shown in FIG. 23, or as shown in FIG. 6 with respect to section 12*c*'**).

When the bottle carrier is supporting a bottle, it is difficult if not impossible, as a practical matter, to reposition the section **12*c*, or 12*c*', from its downward position (FIG. 22, or FIG. 6 with respect to 12*c*) to a horizontal position (FIG. 23, or FIG. 6 with respect to 12*c*'). This is so because intermediate tab 30, or intermediate tabs 30*a*, 30*b*, are flexed upward in a concave-outward curve and up into abutting contact with the underside of the bottle rim as previously described. Consequently, for all practical purposes, no upward bending force on section 12*c*, or 12*c*', will result in a stable horizontal position being assumed for section 12*c*, or 12*c*'**.

Figure 24:
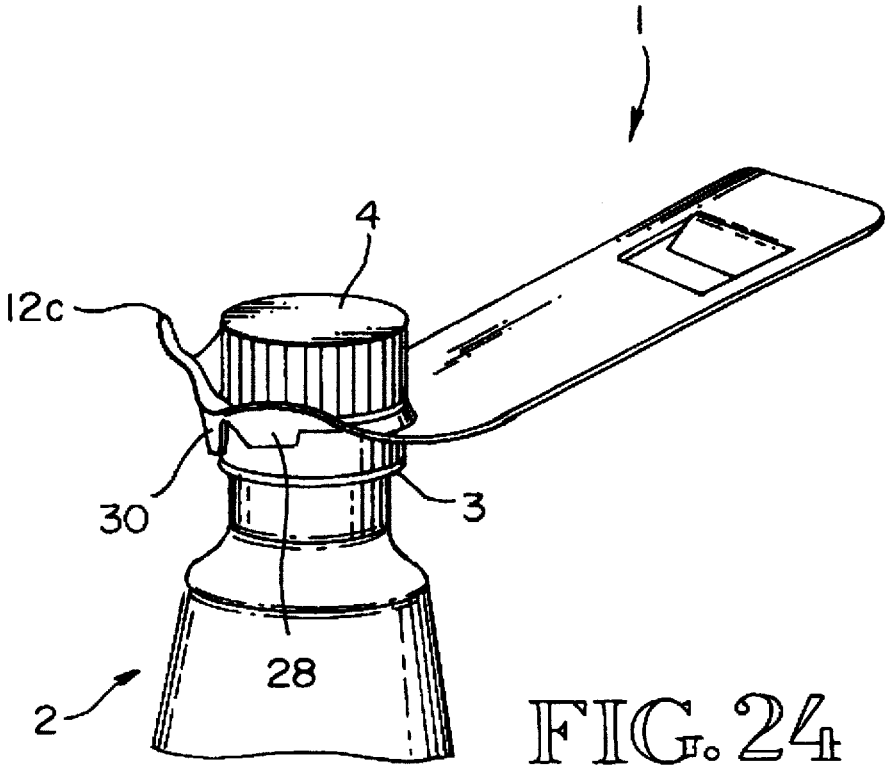
FIG. 24 is a partial perspective view of the FIG. 20 bottle carrier and bottle combination, as the bottle carrier would appear while being removed from the bottle.

However, when the weight of the bottle and its contents is relieved from the bottle engaging portion 12, or 12', section **12*c*, or 12*c*', can be shifted to a generally horizontal position with ease. When shifted to the relaxed horizontal position, the intermediate tab 30, or intermediate tabs 30*a*, 30*b*, straighten(s) out and become(s) generally co-planer with section 12, or 12', with edge 31, or edges 31*a*, 31*b*, being release from engagement with the underside of the bottle rim. When edge 31, or edges 31*a*, 31*b*, is/are released from the underside of the bottle rim, section 12, or 12', can be pulled upward thereby causing intermediate tab 31, or tabs 31*a*, 31*b*, to reverse and extend downward, as shown in FIG. 24, so that the bottle engaging portion 12, or 12', can be completely pulled up and off of the bottle. If the bottle carrier is not attached to a belt or strap, as is seen in FIGS. 20–24, the bottle carrier would be typically pulled off of the bottle as just described. However, if the bottle carrier were attached to another bottle, such as seen in FIG. 6, or attached to a user's belt, then the bottle would be typically pulled down and out of the bottle carrier, the user merely holding the end of section 12, or 12', while pulling downward on the bottle. Whether the bottle carrier is pulled up or the bottle is pulled down, the relative actions of the aperture peripheral elements as herein described in the same. Furthermore, when side tabs 26 and 28, seen in FIG. 2A, are present along with intermediate tab 30, or intermediate tabs 30*a*, 30*b*, they behave in the same manner as the intermediate tab(s), as is seen in FIGS. 23 and 24, when a bottle is removed from the bottle engaging portion 12, 12'**.

In all of the Figures, section **12*c* of the bottle engaging portion 12 (and section 12*c*' of portion 12') is shown to be enlarged at its outermost end so that the very end-most part of section 12*c*, or 12*c*', appears as a tab. This enlarged end part of section 12*c*, or 12*c*', provides an area that may be gripped between a user's thumb and the forefinger when either lifting the bottle engaging portion up off the bottle top or pulling the bottle top down through the bottle engaging portion. FIG. 2 depicts the enlarged end part of section 12*c* to be only slightly greater than the adjacent part of section 12*c*. FIG. 2A depicts the enlarged end part of section 12*c* to be substantially greater than the adjacent part of section 12*c*. Where the bottle carrier is intended for uses that will require removal from a bottle, the configuration of FIG. 2A would be preferred because it would be a more convenient configuration for gripping between a user's thumb and forefinger. An enlarged end part for section 12c provides an additional benefit in that it enhances the stability of the intermediate tab 30, or tabs 30a, 30b, when engaged to the underside of the bottle rim 3**.

FIGS. 18 and 19 illustrate a version of the bottle carrier that is suitable for fabrication from cardboard or plasticized paper. In this version, the carrying portion 16 is provided with an extended somewhat C-shaped section 16a that can be bent along the top edge 52 of the handle 54 to provide reinforcement alongside of the finger aperture 50 and to the handle 54 itself. FIG. 18 shows the version as it would be cut out of a larger sheet of material, and FIG. 19 shows its finished state. In FIG. 19, section 16a has been bent around edge 52 to overlay the handle 54 and the side portions alongside aperture 50, and secured thereto to effectively double the thickness in this region of the bottle carrier. When fabricated from cardboard or paper material, the provision of creases 13 at the base of the aperture peripheral tab elements is important to ensure that the effective opening for aperture 18 will be as large as intended.

In all versions of the bottle carrier 1, the flap 56, when bent upward to provide turned edge 58 at the bottom of the handle 54, stiffens handle 54 and prevents it from bending or bowing under the weight of the bottle and its contents. When a user extends his or her fingers through aperture 50 so as to grip handle 54, the flap 56 will be turned from the position shown in FIG. 3 to the position shown in FIG. 11. In FIG. 11, the handle 54 has pivoted outward and flap 56 and handle 54 become balanced about turned edge 58 as shown. This conversion from the FIG. 3 position to the FIG. 11 position occurs naturally when the user lifts the bottle carrier and an attached bottle. The provision of a crease line 60, as shown in FIG. 10, enhances the tendency of the flap 56 to bend upward around turned edge 58 when a user lifts the bottle carrier and attached bottle.

While the preferred embodiment of the invention has been described herein, variations in the design may be made. Also various manufacturing processes may be employed to fabricate the bottle carrier of this invention; such as molding, stamping, die cutting, laser cutting, and the like. The scope of the invention, therefore, is only to be limited by the claims appended hereto.

The embodiments of the invention in which an exclusive property is claimed are defined as follows:

1. A bottle carrier for carrying at least one capped bottle of the type having a rim separating a bottle neck from a bottle cap and a cylindrical bottle cap having a cylindrical outer surface extending substantially above the bottle rim wherein the diameter of the bottle rim is at least as large as the diameter of the bottle cap, which comprises:

a) first bottle engaging means comprising a thin strip of flexible material having an aperture for fitting over the cylindrical bottle cap and the bottle rim adjacent an end of said strip, said aperture being defined by (i) an arcuate edge extending through an arc of at least 180°, (ii) a first side edge extending from a first end of said arcuate edge into said aperture, (iii) a second side edge extending from a second end of said arcuate edge into said aperture, and (iv) at least one intermediate edge extending across said aperture between said first and second side edges;

b) and second bottle engaging means comprising a thin strip of material extending from the strip end toward said aperture and which comprises at least one intermediate tab extending toward said aperture and terminating in said intermediate edge, said intermediate tab being constructed and arranged with respect to said first and second side edges that said intermediate tab can be flexed so as to enlarge the effective opening of said aperture so that a bottle can be inserted into said aperture, said intermediate tab being further constructed and arranged so that said intermediate edge can be contacted with the underside of a bottle rim so as to support a bottle when a bottle has been inserted into said aperture;

said first bottle engaging means being so constructed and arranged that said aperture has a width between the ends of said arcuate edge greater than the diameters of the cylindrical bottle cap and the bottle rim and so that said aperture has a mid-section that is sufficiently large in a direction perpendicular to said width to enable said arcuate edge to extend over the bottle rim and bear against the cylindrical outer surface of the cylindrical bottle cap when a bottle is inserted into said aperture and lifted by said bottle carrier such that the bottle is supported in said bottle carrier by said intermediate edge bearing against an underside of the bottle rim and by said arcuate edge bearing against the cylindrical surface of the cylindrical bottle cap;

and said second bottle engaging means being so constructed and arranged that said intermediate edge is spaced far enough away from the mid-section of said arcuate edge that said bottle carrier may be removed from the bottle by (i) lifting said strip end so as to turn said intermediate edge out of engagement with the underside of the bottle rim and (ii) pulling upward on said strip end to pull said intermediate tab and said arcuate edge upward across the bottle rim and the bottle cap; and c) carrying means connected to said first bottle engaging means so that a bottle inserted into said aperture can be lifted and carried by said bottle carrier.

2. The bottle carrier of claim 1 wherein said first and second bottle engaging means and said carrying means are integrated into a single body with said first and second bottle engaging means being located in one end portion of said body.

3. The bottle carrier of claim 2 wherein said carrying means comprises a handle portion in said body and a transverse flap overlaying a transverse aperture provided in said body, said handle portion and said flap being constructed and arranged so that a user may extend his or her finger or fingers through said transverse aperture to grasp both said handle portion and said flap when lifting the bottle carrier.

4. The bottle carrier of claim 2 wherein said aperture is provided in said body, said first and second side edges are provided in said body adjacent to said ends of said arcuate edge, and said intermediate tab is provided in said body between said first and second side edges.

5. The bottle carrier of claim 4 wherein said first bottle engaging means includes a first side tab provided in said body between said first side edge and said intermediate tab, and includes a second side tab provided in said body between said second side edge and said intermediate tab; said first side tab having a first tab edge extending from said first side edge toward said intermediate edge, and said second side tab having a second tab edge extending from said second side edge toward said intermediate edge; said first tab edge and said intermediate edge being separated from one another, and said second tab edge and said intermediate edge being separated from one another; said first and second side tabs being constructed and arranged with respect to said first and second side edges that said first and second side tabs can be flexed so as to enlarge the effective opening of said aperture so that a bottle can be inserted into said aperture.

6. A bottle carrier for carrying at least one capped bottle of the type having a rim separating a bottle neck from a bottle cap and a cylindrical bottle cap having a cylindrical outer surface extending substantially above the bottle rim wherein the diameter of the bottle rim is at least as large as the diameter of the bottle cap, which comprises:

a) first bottle engaging means comprising a thin strip of flexible material having an aperture for fitting over the cylindrical bottle cap and the bottle rim adjacent an end of said strip, said aperture being defined by (i) an arcuate edge extending through an arc of at least 180°, (ii) a first side edge extending from a first end of said arcuate edge into said aperture, (iii) a second side edge extending from a second end of said arcuate edge into said aperture, and (iv) first and second intermediate edges extending across said aperture between said first and second side edges;

b) and second bottle engaging means comprising a thin strip of material extending from the strip end toward said aperture and which comprises first intermediate tab extending toward said aperture and terminating in said intermediate edge, a second intermediate tab extending toward said aperture and terminating in said second intermediate edge, said first and second intermediate tabs being adjacent to one another and separated from one another, said first and second intermediate tabs being constructed and arranged with respect to said first and second side edges that said first and second intermediate tabs can be flexed so as to enlarge the effective opening of said aperture so that a bottle can be inserted into said aperture, said first and second intermediate tabs being further constructed and arranged so that said intermediate edges can be contacted with the underside of a bottle rim so as to support a bottle when a bottle has been inserted into said aperture;

said first bottle engaging means being so constructed and arranged that said aperture has a width between the ends of said arcuate edge greater than the diameters of the cylindrical bottle cap and the bottle rim and so that said aperture has a mid-section that is sufficiently large in a direction perpendicular to said width to enable said arcuate edge to extend over the bottle rim and bear against the cylindrical outer surface of the cylindrical bottle cap when a bottle is inserted into said aperture and lifted by said bottle carrier such that the bottle is supported in said bottle carrier by said intermediate edges bearing against an underside of the bottle rim and by said arcuate edge bearing against the cylindrical surface of the cylindrical bottle cap;

and said second bottle engaging means being so constructed and arranged that said intermediate edges are spaced far enough away from the mid-section of said arcuate edge that said bottle carrier may be removed from the bottle by (i) lifting said strip end so as to turn said intermediate edges out of engagement with the underside of the bottle rim and (ii) pulling upward on said strip end to pull said intermediate tabs and said arcuate edge upward across the bottle rim and the bottle cap; and c) carrying means connected to said first bottle engaging means so that a bottle inserted into said aperture can be lifted and carried by said bottle carrier.

7. The bottle carrier of claim 6 wherein said first and second bottle engaging means and said carrying means are integrated into a single body with said first and second bottle engaging means being located in one end portion of said body.

8. The bottle carrier of claim 7 wherein said carrying means comprises a handle portion in said body and a transverse flap overlaying a transverse aperture provided in said body, said handle portion and said flap being constructed and arranged so that a user may extend his or her finger or fingers through said transverse aperture to grasp both said handle portion and said flap when lifting the bottle carrier.

9. The bottle carrier of claim 7 wherein said aperture is provided in said body, said first and second side edges are provided in said body adjacent to said ends of said arcuate edge, and said first and second intermediate tabs are provided in said body between said first and second side edges.

10. The bottle carrier of claim 9 wherein said first bottle engaging means includes a first side tab provided in said body between said first side edge and said first intermediate tab, and includes a second side tab provided in said body between said second side edge and said second intermediate tab; said first side tab having a first tab edge extending from said first side edge toward said first intermediate edge, and said second side tab having a second tab edge extending from said second side edge toward said second intermediate edge; said first tab edge and said first intermediate edge being separated from one another, and said second tab edge and said second intermediate edge being separated from one another; said first and second side tabs being constructed and arranged with respect to said first and second side edges that said first and second side tabs can be flexed so as to enlarge the effective opening of said aperture so that a bottle can be inserted into said aperture.

11. A bottle carrier for carrying at least two capped bottles of the type having a rim separating a bottle neck from a bottle cap and a cylindrical bottle cap having a cylindrical outer surface extending substantially above the bottle rim wherein the diameter of the bottle rim is at least as large as the diameter of the bottle cap, which comprises:

a) first bottle engaging means comprising a thin strip of flexible material having a first aperture for fitting over the cylindrical bottle cap and the bottle rim adjacent an end of said strip, said first aperture being defined by (i) a first arcuate edge extending through an arc of at least 180°, (ii) a first side edge extending from a first end of said first arcuate edge into said first aperture, (iii) a second side edge extending from a second end of said first arcuate edge into said first aperture, and (iv) at least one first intermediate edge extending across said first aperture between said first and second side edges;

b) and second bottle engaging means comprising a thin strip of material extending from the strip end toward said first aperture and which comprises at least one first intermediate tab extending toward said first aperture and terminating in said first intermediate edge, said first intermediate tab being constructed and arranged with respect to said first and second side edges that said first intermediate tab can be flexed so as to enlarge the effective opening of said first aperture so that a bottle can be inserted into said first aperture, said first intermediate tab being further constructed and arranged so that said first intermediate edge can be contacted with the underside of a bottle rim so as to support a bottle when a bottle has been inserted into said aperture;

said first bottle engaging means being so constructed and arranged that said first aperture has a width between the ends of said first arcuate edge greater than the diameters of the cylindrical bottle cap and the bottle rim and so that said first aperture has a mid-section that is sufficiently large in a direction perpendicular to said width to enable said first arcuate edge to extend over the bottle rim and bear against the cylindrical outer surface of the cylindrical bottle cap when a bottle is inserted into said first aperture and lifted by said bottle carrier such that the bottle is supported in said bottle carrier by said first intermediate edge bearing against an underside of the bottle rim and by said first arcuate edge bearing against the cylindrical surface of the cylindrical bottle cap;

and said second bottle engaging means being so constructed and arranged that said first intermediate edge is spaced far enough away from the mid-section of said first arcuate edge that said bottle carrier may be removed from the bottle by (i) lifting said strip end so as to turn said first intermediate edge out of engagement with the underside of the bottle rim and (ii) pulling upward on said strip end to pull said first intermediate tab and said first arcuate edge upward across the bottle rim and the bottle cap; and c) third bottle engaging means comprising a thin strip of flexible material having a second aperture for fitting over the cylindrical bottle cap and the bottle rim adjacent an end of said strip, said second aperture being defined by (i) a second arcuate edge extending through an arc of at least 180°, (ii) a first side edge extending from a first end of said second arcuate edge into said second aperture, (iii) a second side edge extending from a second end of said second arcuate edge into said second aperture, and (iv) at least one second intermediate edge extending across said second aperture between said first and second side edges;

d) and fourth bottle engaging means comprising a thin strip of material extending from the strip end toward said second aperture and which comprises at least one second intermediate tab extending toward said second aperture and terminating in said second intermediate edge, said second intermediate tab being constructed and arranged with respect to said first and second side edges that said second intermediate tab can be flexed so as to enlarge the effective opening of said second aperture so that a bottle can be inserted into said second aperture, said second intermediate tab being further constructed and arranged so that said second intermediate edge can be contacted with the underside of a bottle rim so as to support a bottle when a bottle has been inserted into said second aperture;

said third bottle engaging means being so constructed and arranged that said second aperture has a width between the ends of said second arcuate edge greater than the diameters of the cylindrical bottle cap and the bottle rim and so that said second aperture has a mid-section that is sufficiently large in a direction perpendicular to said width to enable said second arcuate edge to extend over the bottle rim and bear against the cylindrical outer surface of the cylindrical bottle cap when a bottle is inserted into said second aperture and lifted by said bottle carrier such that the bottle is supported in said bottle carrier by said second intermediate edge bearing against an underside of the bottle rim and by said second arcuate edge bearing against the cylindrical surface of the cylindrical bottle cap;

and said fourth bottle engaging means being so constructed and arranged that said second intermediate edge is spaced far enough away from the mid-section of said second arcuate edge that said bottle carrier may be removed from the bottle by (i) lifting said strip end so as to turn said second intermediate edge out of engagement with the underside of the bottle rim and (ii) pulling upward on said strip end to pull said second intermediate tab and said second arcuate edge upward across the bottle rim and the bottle cap; and e) carrying means connected to said first and third bottle engaging means so that bottles inserted into said first and second apertures can be lifted and carried by said bottle carrier.

12. The bottle carrier of claim 11 wherein said all of said bottle engaging means and said carrying means are integrated into a single body with said first and second bottle engaging means being located in one end portion of said body and with said third and fourth bottle engaging means being located in another end portion of said body.

13. The bottle carrier of claim 12 wherein said carrying means comprises at least one handle portion in said body and at least one transverse flap overlaying a transverse aperture provided in said body, said handle portion and said flap being constructed and arranged so that a user may extend his or her finger or fingers through said transverse aperture to grasp both said handle portion and said flap when lifting the bottle carrier.

14. The bottle carrier of claim 11 wherein said first bottle engaging means includes a first side tab provided in said body between said first side edge and said first intermediate tab, and includes a second side tab provided in said body between said second side edge and said first intermediate tab, said first side tab having a first tab edge extending from said first side edge toward said first intermediate edge, and said second side tab having a second tab edge extending from said second side edge toward said first intermediate edge, said first tab edge and said first intermediate edge being separated from one another, and said second tab edge and said first intermediate edge being separated from one another, said first and second side tabs being constructed and arranged with respect to said first and second side edges that said first and second side tabs can be flexed so as to enlarge the effective opening of said first aperture so that a bottle can be inserted into said first aperture; and wherein said third bottle engaging means includes a first side tab provided in said body between said first side edge and said second intermediate tab, and includes a second side tab provided in said body between said second side edge and said second intermediate tab, said first side tab having a first tab edge extending from said first side edge toward said second intermediate edge, and said second side tab having a second tab edge extending from said second side edge toward said second intermediate edge, said first tab edge and said second intermediate edge being separated from one another, and said second tab edge and said second intermediate edge being separated from one another, said first and second side tabs being constructed and arranged with respect to said first and second side edges that said first and second side tabs can be flexed so as to enlarge the effective opening of said second aperture so that a bottle can be inserted into said second aperture.

* * * * *